US007480471B2

(12) United States Patent
Kitamura

(10) Patent No.: US 7,480,471 B2
(45) Date of Patent: Jan. 20, 2009

(54) BELT DRIVE DEVICE AND IMAGE FORMING APPARATUS HAVING THE SAME

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 239 days.

(21) Appl. No.: 11/600,077

(22) Filed: Nov. 16, 2006

(65) Prior Publication Data

US 2007/0110471 A1 May 17, 2007

(30) Foreign Application Priority Data

Nov. 16, 2005 (JP) ..... 2005-330999

(51) Int. Cl.
*G03G 15/16* (2006.01)
*G03G 15/01* (2006.01)
*G03G 15/00* (2006.01)

(52) U.S. Cl. ..... 399/101; 399/303; 399/395

(58) Field of Classification Search ..... 399/101, 399/297–299, 302, 303, 308, 395
See application file for complete search history.

(56) References Cited

U.S. PATENT DOCUMENTS 6,104,899 A * 8/2000 Hokari et al. ..... 399/165
6,141,525 A * 10/2000 Tahara ..... 399/395

FOREIGN PATENT DOCUMENTS

JP 2006-162659 6/2006

* cited by examiner

*Primary Examiner*—Hoang Ngo
(74) *Attorney, Agent, or Firm*—Kubotera & Associates, LLC

(57) ABSTRACT

A belt drive device includes: a plurality of rollers; an endless belt placed on the rollers to be movable; a roller shaft shifting member disposed on at lease one end portion of a shaft of at least one of the rollers for shifting the one end portion of the shaft of the one of the rollers according to a movement of the endless belt in a shaft direction of the one of the rollers; a cleaning member disposed to face the one of the rollers; and a shifting member for shifting the cleaning member in the shaft direction of the one of the rollers when the endless belt moves in the shaft direction of the one of the rollers.

14 Claims, 14 Drawing Sheets

FIG. 10 (a)
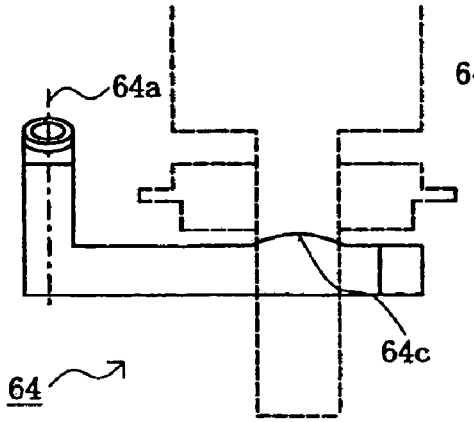
FIG. 10 (b)
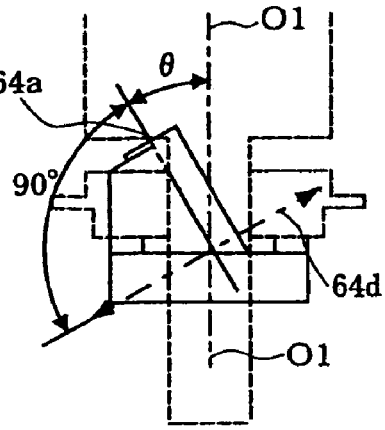
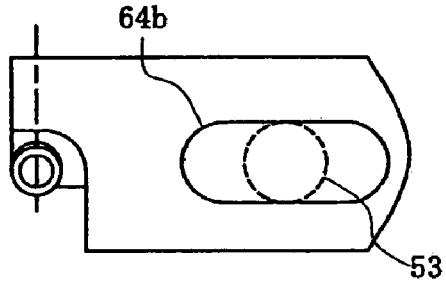
FIG. 10 (c)
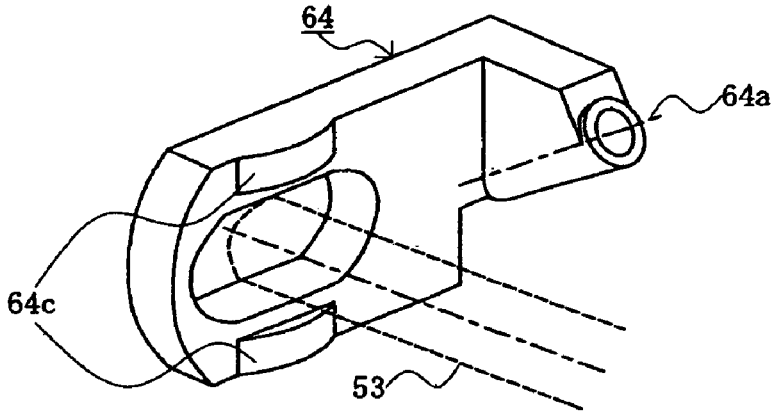
FIG. 11

BELT DRIVE DEVICE AND IMAGE FORMING APPARATUS HAVING THE SAME

BACKGROUND OF THE INVENTION AND RELATED ART STATEMENT

The present invention relates to a belt drive device and an image forming apparatus having the same.

In an image forming process of a conventional image forming apparatus such as a printer, a copier, and a facsimile, first, a photosensitive member as an image supporting member is charged. Then, an exposure device directly exposes an image, or a laser scanning optical system or an LED (Light Emitting Diode) light writing optical system optically writes an image according to an image signal, so that a static latent image is formed on the photosensitive member. Then, a developing device attaches toner to the static latent image to form a toner image, and the toner image is transferred directly or through an intermediate transfer member to a transfer member such as a transfer sheet and film. After the transfer, the transfer member is transported to a fixing device, so that the fixing device fixes the toner image to the transfer member, thereby obtaining a fixed image.

In the series of image forming process, an image forming apparatus may be provided with a belt member such as a photosensitive belt and an intermediate transfer belt as an image supporting member with a surface where a toner image is formed and transferred thereon, or may be provided with a belt member such as a transfer belt as a transporting member of a transfer member.

In such an image forming apparatus, toner may partially remain on a surface of the belt member after the toner image is transferred or the transfer member is transported, thereby causing various problems. To this end, a belt drive device of the image forming apparatus may be provided with a cleaning blade as a cleaning member for mechanically scraping off and removing toner remaining on the surface of the belt member.

When the image forming apparatus is provided with the belt member, the belt member may run in a winding path due to a degree of parallel arrangement of two rollers, uneven tension of the belt member, or dimensional accuracy of a roller. In order to correct the winding path of the belt member, a belt drive device may be provided with a mechanism for shifting a roller shaft according to a lateral movement of a belt member (refer to Patent Reference)

Patent Reference: Japanese Patent Publication No. 2006-162659

In the conventional belt drive device, a cleaning blade is fixed separately from the belt member. Accordingly, when the belt member shifts to left side or right side, there is an area on the belt member where the cleaning blade cannot clean (non-cleanable area). As a result, if the image forming apparatus continues the operation with the belt member shifted, toner or foreign matter may accumulate in the non-cleanable area. Therefore, toner may scatter in a surrounding area of the belt drive device, thereby making inside the image forming apparatus dirty. Further, foreign matter may stick to a surface of a roller driving the belt member to decrease friction therebetween, thereby driving the belt member unevenly.

In view of the problems described above, an object of the present invention is to provide a belt drive device and an image forming apparatus, in which it is possible to solve the problems in the conventional belt drive device. In particular, it is possible to safely correct a winding path of a belt member.

Further objects and advantages of the invention will be apparent from the following description of the invention.

SUMMARY OF THE INVENTION

In order to attain the objects described above, according to one aspect of the present invention, a belt drive device includes: a plurality of rollers; an endless belt placed on the rollers to be movable; a roller shaft shifting member disposed on at lease one end portion of a shaft of at least one of the rollers for shifting the one end portion of the shaft of the one of the rollers according to a movement of the endless belt in a shaft direction of the one of the rollers; a cleaning member disposed to face the one of the rollers; and a shifting member for shifting the cleaning member in the shaft direction of the one of the rollers when the endless belt moves in the shaft direction of the one of the rollers.

In the one aspect of the present invention, the belt drive device includes the roller shaft shifting member disposed on at lease the one end portion of the shaft of at least the one of the rollers for shifting the one end portion of the shaft of the one of the rollers according to a movement of the endless belt in the shaft direction of the one of the rollers; the cleaning member disposed to face the one of the rollers; and the shifting member for shifting the cleaning member in the shaft direction of the one of the rollers when the endless belt moves in the shaft direction of the one of the rollers. Accordingly, it is possible to clean the endless belt over a whole width thereof, thereby achieving safe cleaning performance.

According to another aspect of the present invention, a belt drive device includes: a roller shaft shifting member disposed on at lease one end portion of a shaft of at least one of rollers for shifting the shaft of the one of the rollers according to a movement of an endless belt in a shaft direction of the one of the rollers; a cleaning member abutting against a surface of the endless belt; and an urging member disposed at a position facing the cleaning member with the endless belt in between. The cleaning member and the urging member are disposed at an upstream side in a rotational direction of the endless belt relative to the one of the rollers. Accordingly, it is possible to clean the endless belt over a whole width thereof, thereby achieving safe cleaning performance and stably correcting a winding path of the endless belt.

BRIEF DESCRIPTION OF THE DRAWINGS

FIGS. 10(*a*) to 10(*c*) are schematic views showing a roller tilting lever according to the first embodiment of the present invention, wherein FIG. 10(*a*) is a plan view thereof, FIG. 10(*b*) is a side view thereof, and FIG. 10(*c*) is a front view thereof;

FIG. 11 is a schematic perspective view showing the roller tilting lever according to the first embodiment of the present invention;

DETAILED DESCRIPTION OF PREFERRED EMBODIMENTS

Hereunder, embodiments of the present invention will be explained with reference to the accompanying drawings.

First Embodiment

Figure 2:
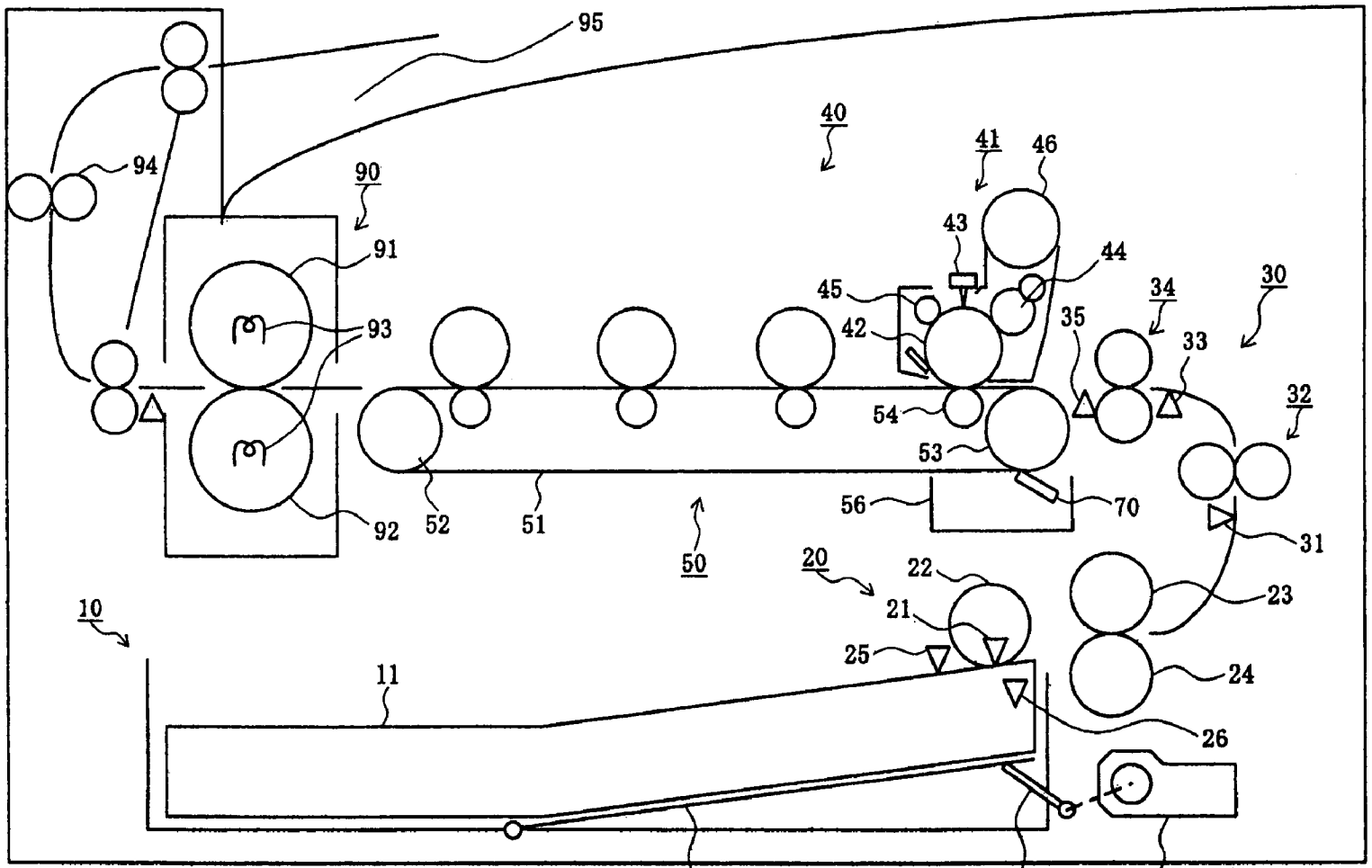
FIG. 2 is a schematic view showing an image forming apparatus according to the first embodiment of the present invention.

FIG. 2 is a schematic view showing an image forming apparatus according to a first embodiment of the present invention. As shown in FIG. 2, the image forming apparatus includes a sheet tray 10 detachably installed in the image forming apparatus, so that sheets 11 as recoding media are placed thereon. A sheet placing plate 12 is disposed in the sheet tray 10 on a supporting shaft (not shown) to be rotatable, so that the sheets 11 are placed on the sheet placing plate 12.

A guide member (not shown) is disposed on the sheet tray 10 for regulating a placing position of the sheets 11. Accordingly, the guide member regulates a side position of the sheets 11 in a direction perpendicular to a direction that the sheets 11 are drawn (right direction in FIG. 2) and the placing position of the sheets 11 relative to the direction that the sheets 11 are drawn.

A lift-up lever 13 is disposed on a supporting shaft (not shown) to be rotatable at a side that the sheets 11 are drawn, and the supporting shaft engages a motor 14 to be separable therefrom. When the sheet tray 10 is inserted into the image forming apparatus, the lift-up lever 13 engages the motor 14, and a control unit (not shown) drives the motor 14. When the lift-up lever 13 rotates, a distal end portion of the lift-up lever 13 lifts a bottom portion of the sheet placing plate 12, so that the sheets 11 placed on the sheet placing plate 12 move upward. When the sheets 11 move upward to a certain point, a lifting detection unit 21 detects the sheets 11, so that the control unit stops the motor 14 according to information detected by the lifting detection unit 21.

A sheet drawing unit 20 is provided at a side of the sheet tray 10 for drawing the sheets 11 one by one from the top thereof. The sheet drawing unit 20 is provided with a pick-up roller 22 for pressing the sheets 11 at a certain height, and a pair of rollers formed of a feed roller 23 for separating the sheets 11 drawn by the pick-up roller 22 one by one and a retard roller 24. The sheet drawing unit 20 is also provided with a sheet detection section 25 for detecting the sheets 11 and a remaining sheet detection section 26 for detecting a remaining portion of the sheets 11.

After the sheet drawing unit 20 separates and draws one of the sheets 11, the sheet 11 is transported to a sheet transport unit 30. Then, the sheet 11 passes through a sheet sensor 31, and is transported to a pair of transport rollers 32. A drive unit (not shown) controlled by the control unit drives the transport rollers 32 to transport the sheet 11 according to a timing when the sheet 11 passes through the sheet sensor 31. In general, the transport rollers 32 start rotating at a timing delayed relative to the timing when the sheet 11 passes through the sheet sensor 31, so that the sheet 11 is pushed against a pressing portion of the transport rollers 32, thereby collecting skew of the sheet 11.

After the transport rollers 32 transport the sheet 11, the sheet 11 passes through a sheet sensor 33, and is transported to a pair of transport rollers 34. A drive unit (not shown) rotates the transport rollers 34 to transport the sheet 11 from when the sheet 11 passes through the sheet sensor 33 without stopping the sheet 11. After the transport rollers 34 transport the sheet 11, the sheet 11 passes through a writing sensor 35, and is transported to an image forming unit 40.

The image forming unit 40 is provided with four toner image forming units 41 arranged in a row and a transfer unit 50 for transferring a toner image formed with the toner image forming unit 41 to an upper surface of the sheet 11 with Coulomb force. The toner image forming unit 41 is provided with an OPC (organic Photo Conductor) drum 42 for supporting a toner image; a charging roller 45 for uniformly charging a surface of the OPC drum 42; an LED head 43 formed of an LED array for forming a latent image on the charged surface of the OPC drum 42; a developing roller 44 for forming a toner image on the latent image with friction charge; and a toner supply section 46 for supplying toner.

The transfer unit 50 is provided with a transfer belt or an endless belt 51 for statically attracting and transporting the sheet 11; a drive roller 52 driven by a drive unit (not shown) for driving the endless belt 51; an idle roller 53 paired with the drive roller 52 for extending the endless belt 51; transfer rollers 54 arranged to face the toner image forming units 41 and pressed against the OPC drums 42 with the endless belt 51 in between for applying a voltage so that the toner image is transferred to the sheet 11; a cleaning blade unit or cleaning member 70 for scraping and removing toner stick to the endless belt 51; and a toner box 56 for accumulating toner scraped off by the cleaning blade unit 70.

The toner image forming units 40 and the endless belt 51 are driven in a synchronized fashion, so that the toner images are sequentially overlapped and transferred to the sheet 11 statically attracted to the endless belt 51. After the image forming unit 40 transfers the image to the sheet 11, the sheet 11 is transported to a fixing unit 90 for fixing the toner images to the sheet 11 with heat and pressure.

The fixing unit 90 is provided with a halogen lamp or heat source 93, and a pair of rollers such as an upper roller 91 and a lower roller 92 with an elastic member formed on surfaces thereof. The fixing unit 90 applies heat and pressure to the toner images on the sheet 11 transported from the image forming unit 40, so that the toner images are melt and fixed to the sheet 11. Afterward, a discharge roller 94 discharges the sheet 11 to a stacker 95.

A configuration of a belt drive device of the transfer unit 50 will be explained next. First, a conventional belt drive device disclosed in Patent Reference will be explained as a comparative example.

Figure 3:
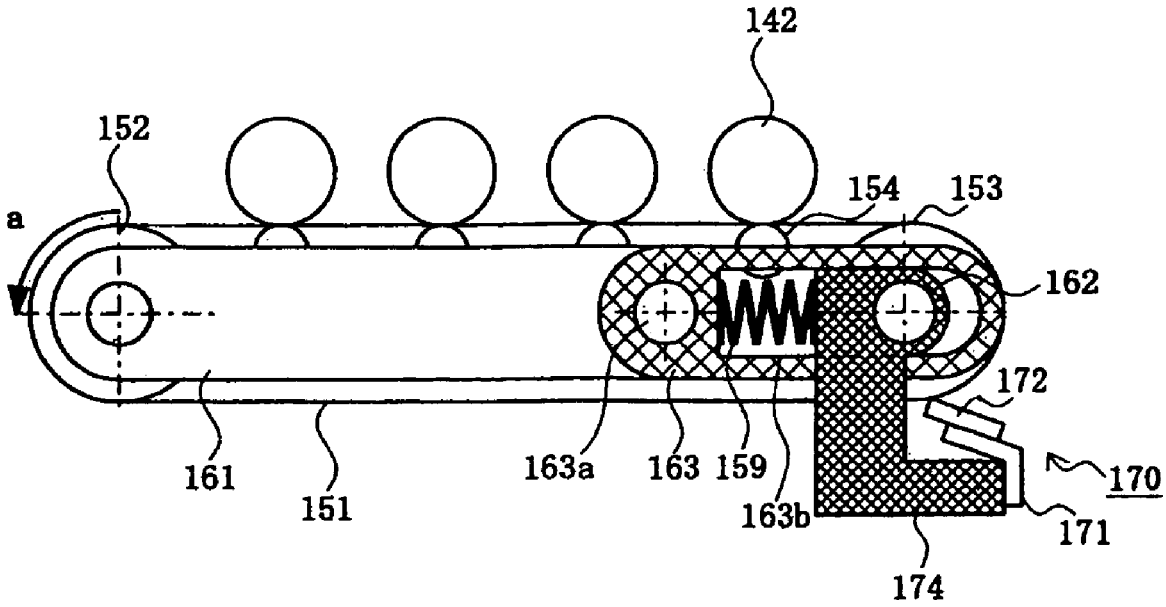
FIG. 3 is a schematic side view showing a conventional belt drive device as a comparative example.
Figure 4:
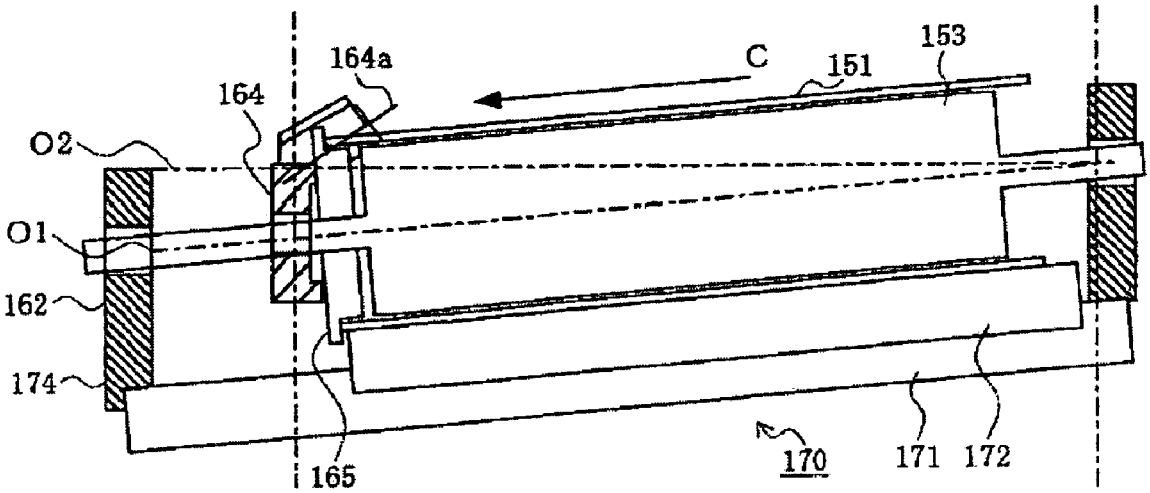
FIG. 4 is a schematic view (No. 1) showing an operation of the conventional belt drive device as the comparative example.
Figure 5:
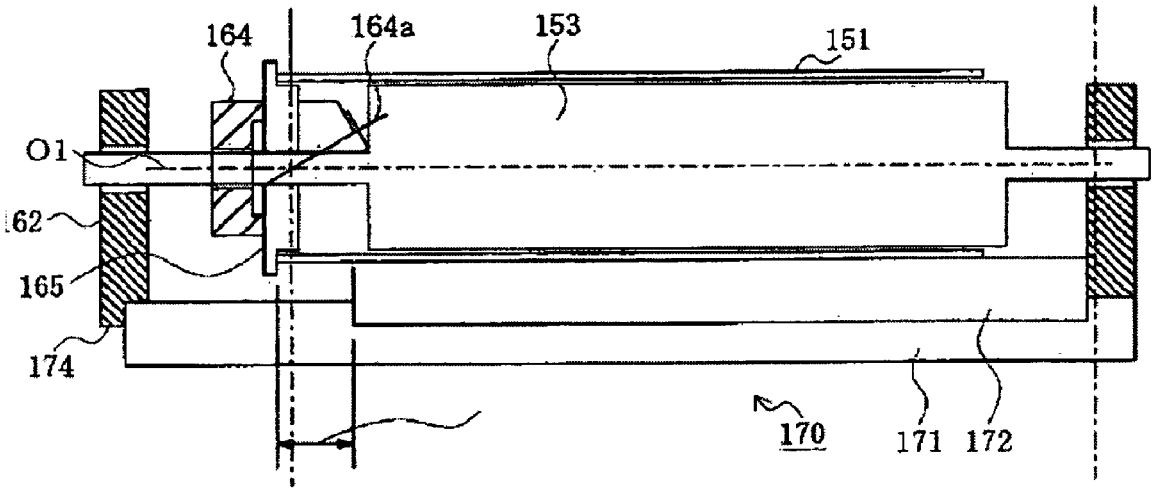
FIG. 5 is a schematic view (No. 2) showing the operation of the conventional belt drive device as the comparative example.
Figure 6:
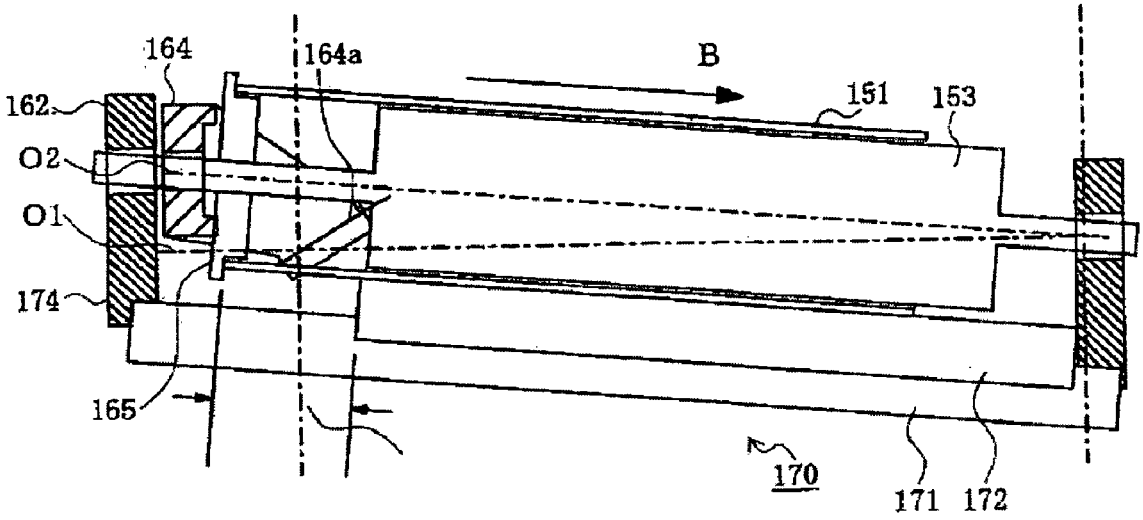
FIG. 6 is a schematic view (No. 3) showing the operation of the conventional belt drive device as the comparative example.

FIG. 3 is a schematic side view showing the conventional belt drive device as the comparative example. FIG. 4 is a schematic view (No. 1) showing an operation of the conventional belt drive device as the comparative example. FIG. 5 is a schematic view (No. 2) showing the operation of the conventional belt drive device as the comparative example. FIG. 6 is a schematic view (No. 3) showing the operation of the conventional belt drive device as the comparative example.

As shown in FIG. 3, the conventional belt drive device of a transfer unit is supported on a belt frame 161 to be rotatable. The conventional belt drive device is provided with a drive roller 152 having a surface with high friction coefficient and an end portion fixed to a gear; an idle roller 153 having both end portions supported on a shaft bearing 162 to be rotatable; and the likes.

The shaft bearing 162 is supported in a hole (not shown) of the belt frame 161 to be able to slide. A spring 159 urges the shaft bearing 162, so that the shaft bearing 162 extends a transfer belt 151. With the configuration described above, the transfer belt 151 moves in an arrow direction a. OPC drums 142 and transfer rollers 154 are arranged with the transfer belt 151 in between.

In the belt frame 161, an arm or a roller shaft shifting member 163 is supported on a rotational shaft 163*a* to be rotatable. The shaft bearing 162 is disposed in a hole 163*b* of the arm 163 to be able to slide, so that the idle roller 153 is supported to be rotatable.

As shown in FIGS. 4 to 6, a pulley 165 is disposed on one end portion of the idle roller 153 to be rotatable coaxially and movable in a shaft direction. A roller tilting lever or roller shaft shifting member 164 is disposed between the arm 163 and the pulley 165. The roller tilting lever 164 has a rotational shaft 164*a* inclined relative to a rotational axis O1 of the drive roller 152. It is arranged such that the roller tilting lever 164 tilts the shaft of the idle roller 153 according to a winding path of the transfer belt 151.

A cleaning blade 170 having a holder 171 and a blade 172 is provided adjacent to the idle roller 153. The holder 171 engages a blade bracket 174 extending below the shaft bearing 162, and the cleaning blade 170 moves according to a movement of the idle roller 153.

In the conventional belt drive device, the pulley 165 is disposed on the one end portion of the idle roller 153, and the pulley 165 has a flange portion having a diameter greater than that of the idle roller 153. As a result, it is difficult to dispose the cleaning blade 170 over the flange portion of the pulley 165. Accordingly, when the transfer belt 151 is shifted to the furthermost right side as shown in FIG. 4, it is possible to clean the whole width of the transfer belt. However, when the transfer belt 151 is shifted to the left side as shown in FIGS. 5 and 6, there is an area on the transfer belt 151 where the cleaning blade 170 cannot clean (non-cleanable area).

When the image forming apparatus continues an operation in a state that there is the non-cleanable area, toner or a foreign matter may accumulate on the non-cleanable area. When this happens, toner may spread in a surrounding area of the belt drive device to make inside the image forming apparatus dirty, or a foreign matter may stick to a surface of the drive roller 152 to reduce friction thereof, thereby making it difficult to drive the transfer belt 151.

In the belt drive device according to the first embodiment of the present invention, it is possible to prevent the non-cleanable area from occurring. A configuration of the belt drive device according to the first embodiment of the present invention will be explained next.

Figure 1:
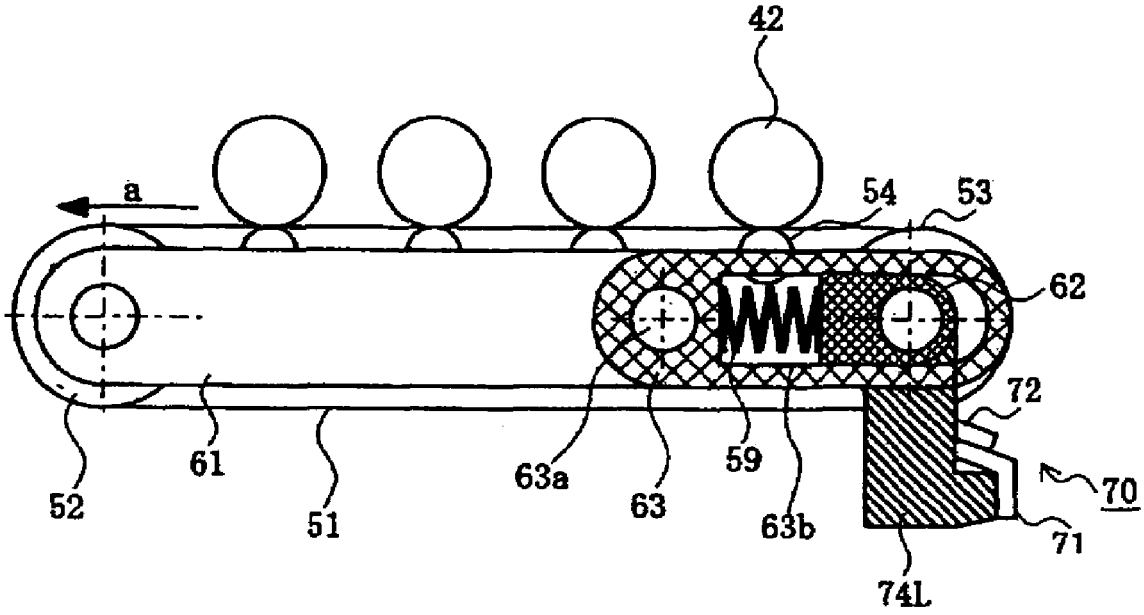
FIG. 1 is a schematic side view showing a belt drive device according to a first embodiment of the present invention.
Figure 7:
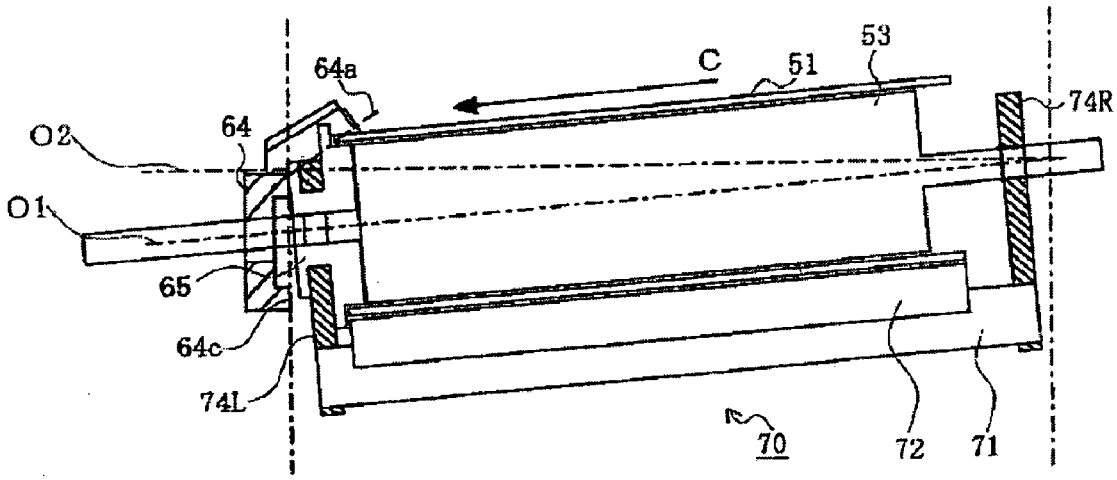
FIG. 7 is a schematic view (No. 1) showing an operation of the belt drive device according to the first embodiment of the present invention.
Figure 8:
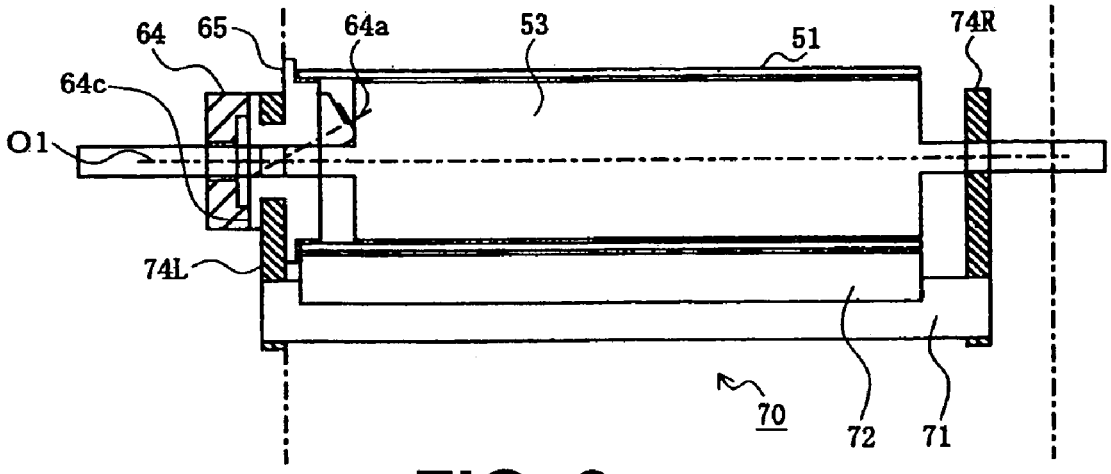
FIG. 8 is a schematic view (No. 2) showing the operation of the belt drive device according to the first embodiment of the present invention.
Figure 9:
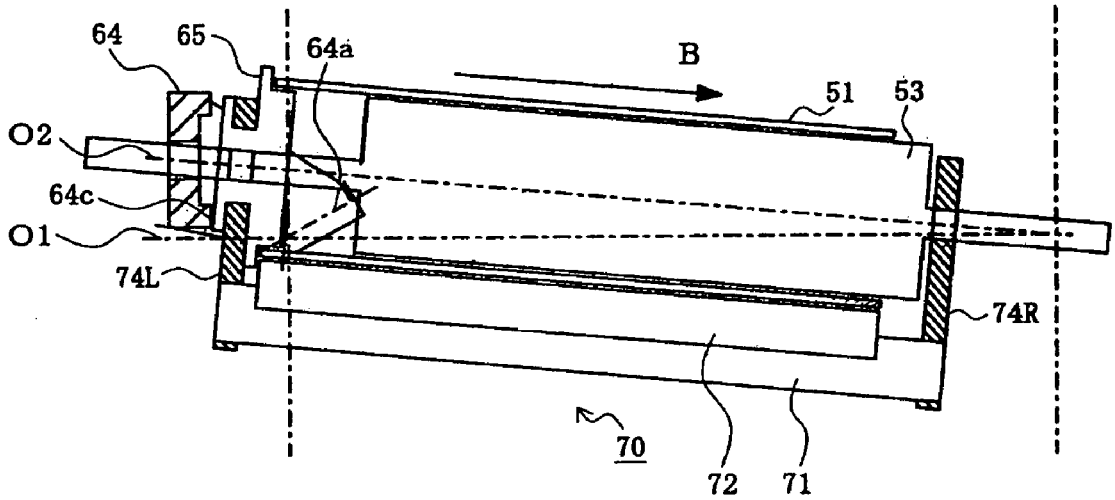
FIG. 9 is a schematic view (No. 3) showing the operation of the belt drive device according to the first embodiment of the present invention.

FIG. 1 is a schematic side view showing the belt drive device according to the first embodiment of the present invention. FIG. 7 is a schematic view (No. 1) showing an operation of the belt drive device according to the first embodiment of the present invention. FIG. 8 is a schematic view (No. 2) showing the operation of the belt drive device according to the first embodiment of the present invention. FIG. 9 is a schematic view (No. 3) showing the operation of the belt drive device according to the first embodiment of the present invention.

As shown in FIG. 1, the belt drive device of the transfer unit 50 is supported on a belt frame 61 to be rotatable. The belt drive device is provided with a drive roller 52 having a surface with high friction coefficient and an end portion fixed to a gear; an idle roller 53 having both end portions supported on a shaft bearing 62 to be rotatable; and the likes.

The shaft bearing 62 is supported in a hole of the belt frame 61 to be able to slide. A spring 59 urges the shaft bearing 62, so that the shaft bearing 62 extends a transfer belt 51. With the configuration described above, the transfer belt 51 moves in an arrow direction a. The transfer belt 51 is formed of an elastic resin such as polyimide or urethane through centrifuge molding, and may be formed of other materials.

In the belt frame 61, an arm or a roller shaft shifting member 63 is supported on a rotational shaft 63*a* to be rotatable. The shaft bearing 62 is disposed in a hole 63*b* of the arm 63 to be able to slide, so that the idle roller 53 is supported to be rotatable.

As shown in FIGS. 7 to 9, a flange portion is coaxially disposed on one end portion of the idle roller 53. The flange portion has an outer circumference contacting with an end portion of the transfer belt 51. A pulley 65 having a groove in an outer circumference thereof is disposed outside the flange portion to be rotatable and able to slide in a shaft direction. The pulley 65 functions as a shaft direction detection member.

A left side blade bracket 74L is disposed to engage the groove of the pulley 65 to be rotatable. A right side blade bracket 74R is disposed on the other end portion of the idle roller 53 to engage a shaft of the idle roller 53 to be rotatable. The left side blade bracket 74L and the right side blade bracket 74R constitute a blade bracket 74.

A cleaning blade unit 70 is provided with a holder 71 and a cleaning blade 72 formed of an elastic member abutting against the endless belt 51. Both end portions of the holder 71 are fixed to the left side blade bracket 74L and the right side blade bracket 74R, respectively.

The left side blade bracket 74L and the right side blade bracket 74R are regulated with a rotational regulating member (not shown) to be non-rotatable. Accordingly, the blade bracket 74 and the cleaning blade unit 70 are arranged to be rotatable relative to the pulley 65 and movable together with the pulley 65 in the shaft direction of the idle roller 53. In this case, the pulley 65, the left side blade bracket 74L, and the right side lade bracket 74R function as a moving mechanism for moving the cleaning blade unit 70 in the shaft direction of the idle roller 53. The cleaning blade unit 70 moves in an inclined state according to a movement of the idle roller 53. The cleaning blade unit 70 has a width equal to or slightly greater than that of the endless belt 51.

A roller tilting lever or roller shaft shifting member 64 is disposed between the arm 63 and the pulley 65. The roller tilting lever 64 has a rotational shaft 64*a* inclined relative to a rotational axis O1 of the drive roller 52. The roller tilting lever 64 will be explained next in more detail.

Figure 12:
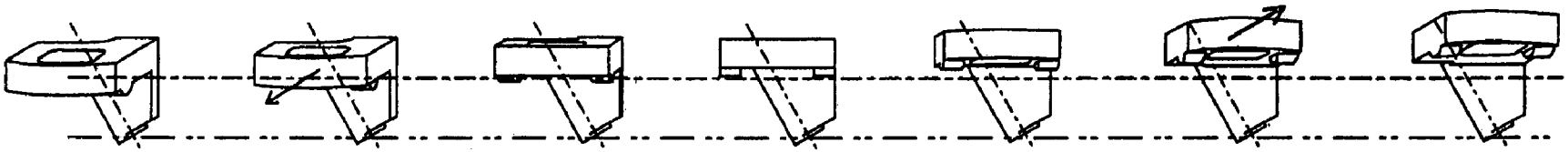
FIG. 12 is a schematic view showing an operation of the roller tilting lever according to the first embodiment of the present invention.

FIGS. 10(*a*) to 10(*c*) are schematic views showing the roller tilting lever 64 according to the first embodiment of the present invention, wherein FIG. 10(*a*) is a plan view thereof, FIG. 10(*b*) is a side view thereof, and FIG. 10(*c*) is a front view thereof. FIG. 11 is a schematic perspective view showing the roller tilting lever 64 according to the first embodiment of the present invention. FIG. 12 is a schematic view showing an operation of the roller tilting lever 64 according to the first embodiment of the present invention.

As shown in FIGS. 10(*a*)-10(*c*) and 11, the roller tilting lever 64 has the rotational shaft 64*a* inclined relative to the rotational axis 01 of the drive roller 52 by an angle θ. The shaft of the idle roller 53 passes through an oval hole portion 64*b* to be rotatable and able to slide. A recess portion 64*c* is arranged to contact with the pulley 65.

Since the roller tilting lever 64 has the rotational shaft 64*a* in the inclined state, the roller tilting lever 64 rotates while drawing a path 64*d* shown in FIG. 10(*b*). Accordingly, when a shaft end portion of the idle roller 53 is tilted downward in FIG. 1, the roller tilting lever 64 rotates downward and away from the idle roller 53 to push the pulley 65. When the roller tilting lever 64 rotates around the rotational shaft 64*a*, a posture of the roller tilting lever 64 continuously changes as shown in FIG. 12.

In the first embodiment, the cleaning blade unit 70 is provided as the cleaning device for cleaning the endless belt 51. Alternatively, the cleaning device may be formed of a fur brush roller for scraping off toner or a foreign matter on the endless belt 51; a rotatable cleaning roller and a cleaning blade, in which the cleaning roller contacts with the endless belt 51 to stick toner or foreign matters thereon, and the cleaning blade contacts with the cleaning roller to scrape off toner or a foreign matter on the cleaning roller; and a combination thereof.

An operation of the belt drive device will be explained next. First, when the endless belt 51 is shifted to the right side as shown in FIG. 7, the pulley 65 is situated at the right side to contact with a side surface of the endless belt 51. Accordingly, the roller tilting lever 64 moves downward with a weight of the idle roller 53 and rotates around the rotational shaft 64*a* to be urged toward the idle roller 53. As a result, the idle roller 53 is inclined as shown in FIG. 7. At this time, the cleaning blade unit 70 moves toward the right side together with the pulley 65 or the endless belt 51 through the blade bracket 74.

When the drive roller 52 rotates and the endless belt 51 starts moving, the endless belt 51 moves in a winding path in an arrow direction C. At this time, the endless belt 51 pushes the pulley 65 to move together with the cleaning blade unit 70 in the arrow direction C. Since the roller tilting lever 64 contacts with the pulley 65 through the recess portion 64*c*, the pulley 65 pushes the roller tilting lever 64 to rotate around the rotational shaft 64*a* to a position shown in FIG. 8.

In this case, the cleaning blade unit 70 moves together with the endless belt 51. In a state shown in FIG. 8, a rotational axis 02 of the idle roller 53 becomes substantially parallel to the rotational axis 01 of the drive roller 52. Accordingly, the winding path of the endless belt 51 changes close to a straight path and stays in the state shown in FIG. 8, so that the endless belt 51 moves stably.

When the endless belt 51 is shifted to the left side, the pulley 65 is situated at the left side and the roller tilting lever 64 is urged toward the left side. Accordingly, the roller tilting lever 64 rotates around the rotational shaft 64*a* and the idle roller 53 is tilted as shown in FIG. 9. When the idle roller 53 is tilted, the endless belt 51 shifts in an arrow direction B while moving, so that the pulley 65 moves in the arrow direction B. Accordingly, the roller tilting lever 64 moves downward with the weight of the idle roller 53, so that the recess portion 64*c* contacts with the pulley 65, and rotates toward the idle roller 53. As a result, the endless belt 51 moves stably in the state shown in FIG. 8. In this case, the cleaning blade unit 70 moves together with the endless belt 51.

In the first embodiment, the cleaning blade unit 70 moves together with the pulley 65, i.e., the shaft direction detection member of the endless belt 51. Accordingly, it is possible to prevent the non-cleanable area from occurring due to the winding path of the endless belt 51.

As described above, in the first embodiment, the cleaning blade unit 70 moves together with the pulley 65, i.e., the shaft direction detection member of the endless belt 51. As a result, even when the endless belt 51 is shifted, the cleaning blade unit 70 is not shifted from the endless belt 51. Accordingly, it is possible to prevent the non-cleanable area from occurring due to the cleaning blade unit 70 not contacting with the endless belt 51. Therefore, it is possible to prevent the problem, in which toner may spread in a surrounding area of the belt drive device, or a foreign matter may stick to the surface of the drive roller 52 driving the endless belt 51 to reduce friction therebetween, thereby making it difficult to drive the endless belt 51.

Second Embodiment

A second embodiment of the present invention will be explained next. In the description below, elements in the second embodiment same as those in the first embodiment are designated by same reference numerals, and explanations thereof are omitted. The elements same as those in the first embodiment provide same effects.

Figure 13:
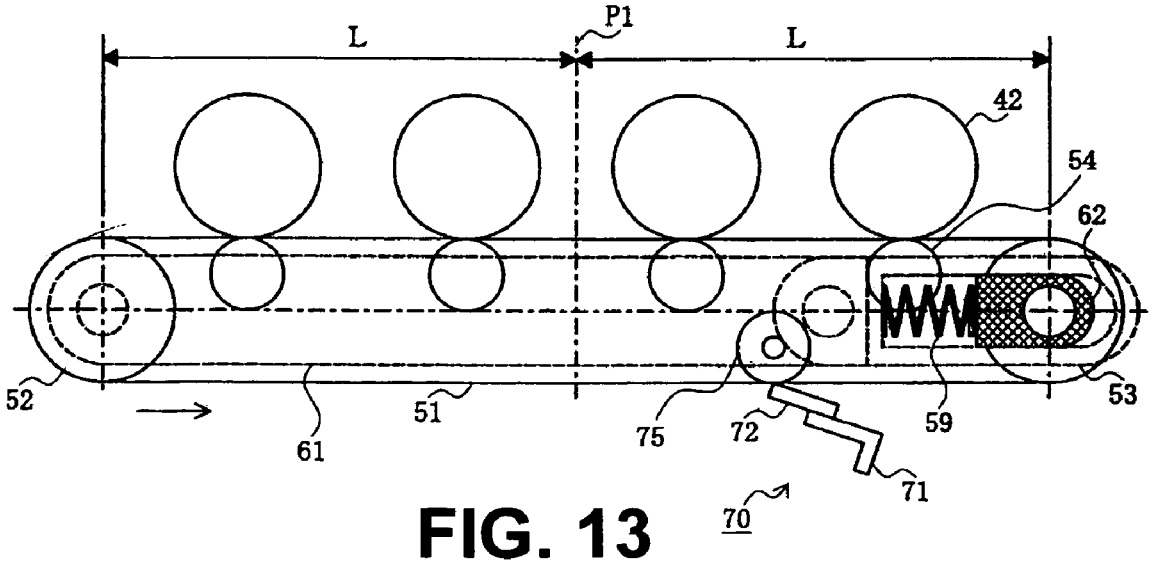
FIG. 13 is a schematic side view showing a belt drive device according to a second embodiment of the present invention.

FIG. 13 is a schematic side view showing a belt drive device according to the second embodiment of the present invention.

In the second embodiment, the left side blade bracket 74L and the right side blade bracket 74R in the first embodiment are omitted. As shown in FIG. 13, in the belt drive device of the transfer unit 50, the belt frame 61 is provided with a support roller or an urging member 75 attached to be rotatable. The cleaning blade unit 70 is attached to a frame member (not shown) at a position where the cleaning blade unit 70 faces the urging member 75 and abuts against the endless belt 51.

In the second embodiment, the urging member 75 and the cleaning blade unit 70 are situated at an upstream side of the idle roller 53 toward the idle roller 53 relative to an intermediate point P1 between the drive roller 52 and the idle roller 53. The support roller 75 is arranged to contact with an inner surface of the endless belt 51 in an extended state that the drive roller 52 and the idle roller 53 are arranged in parallel.

The cleaning blade unit 70 has a width equal to or greater than a sum of the width of the endless belt 51 and a winding width of the endless belt 51. With the configuration described above, the cleaning blade unit 70 can clean the endless belt 51 over the whole width thereof including the winding width.

An operation of the belt drive device according to the second embodiment of the present invention will be explained next.

Figure 14:
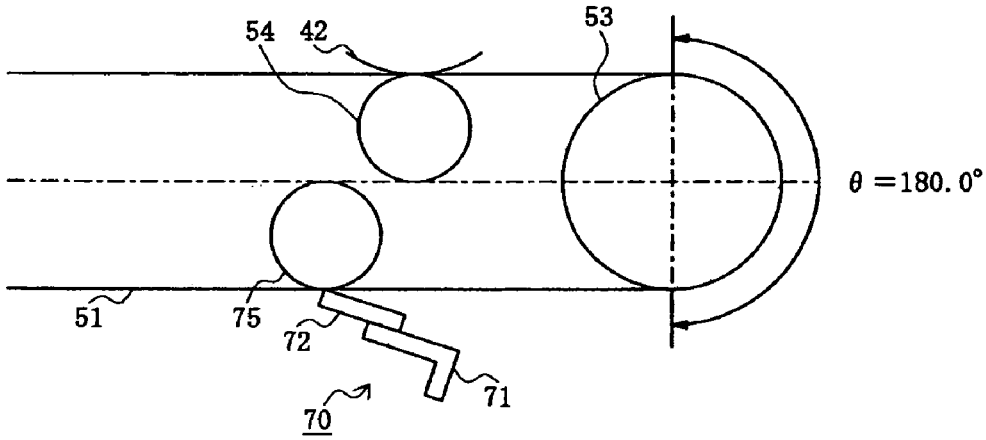
FIG. 14 is a schematic view (No. 1) showing an operation of the belt drive device according to the second embodiment of the present invention.
Figure 15:
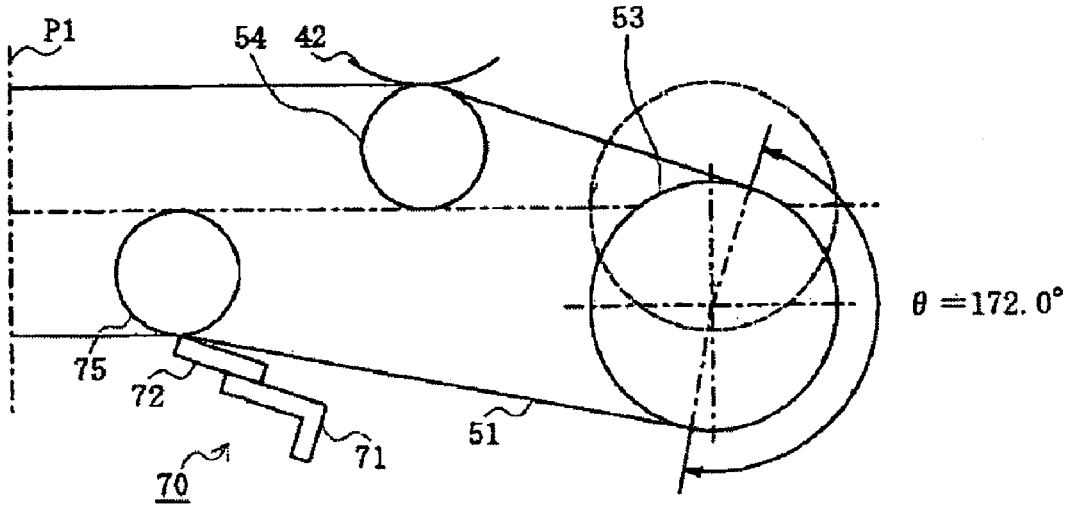
FIG. 15 is a schematic view (No. 2) showing the operation of the belt drive device according to the second embodiment of the present invention.
Figure 16:
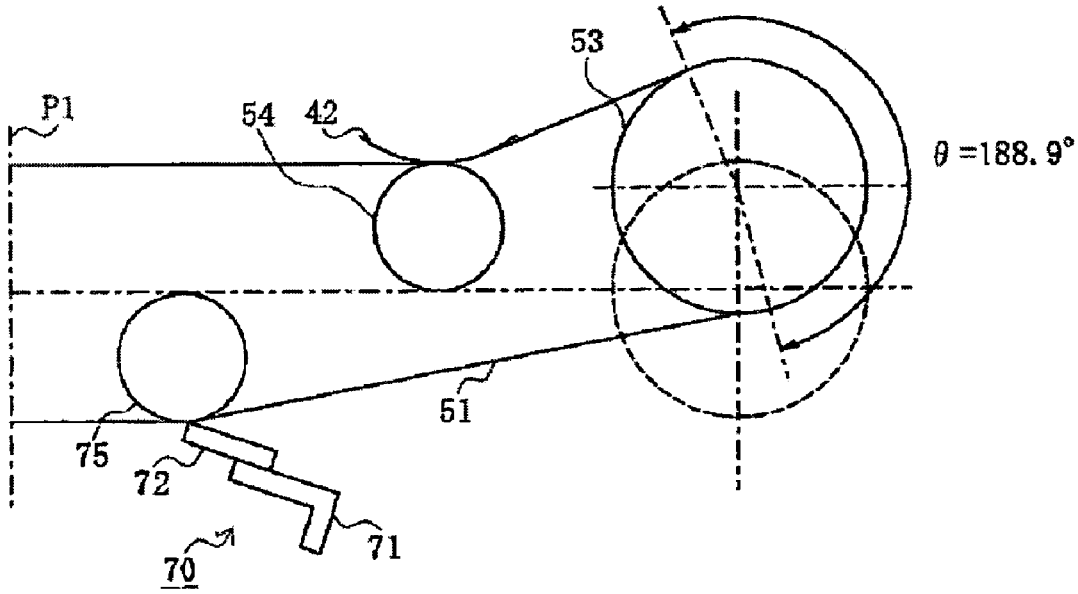
FIG. 16 is a schematic view (No. 3) showing the operation of the belt drive device according to the second embodiment of the present invention.
Figure 17:
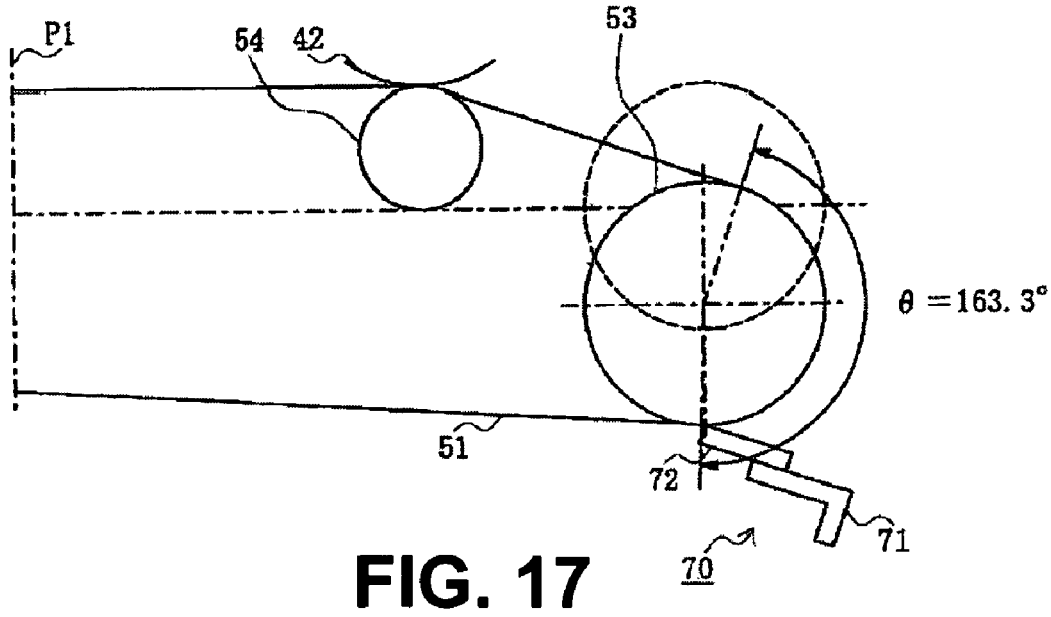
FIG. 17 is a schematic perspective view showing the operation of the belt drive device according to the first embodiment of the present invention compared with FIG. 15.
Figure 18:
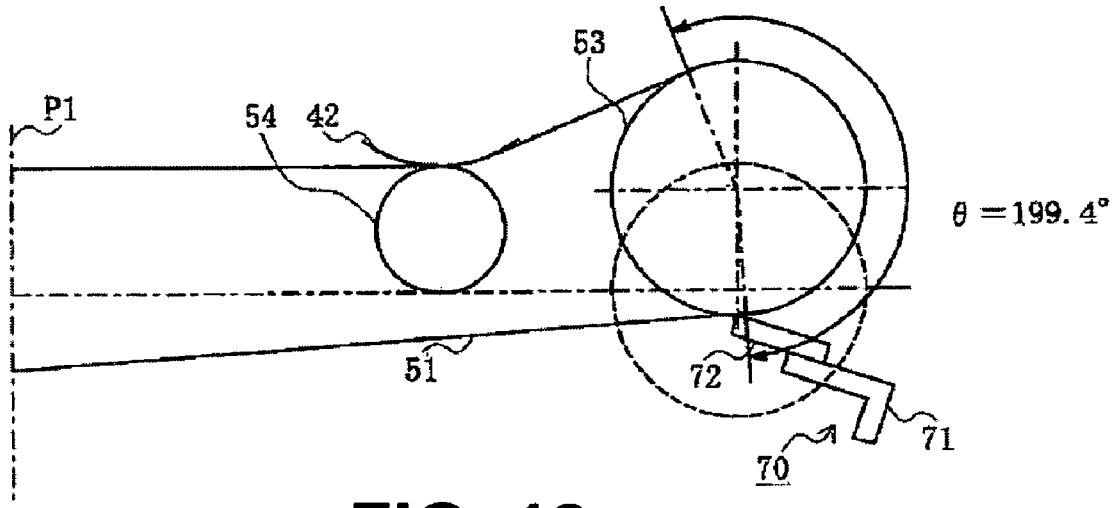
FIG. 18 is a schematic perspective view showing the operation of the belt drive device according to the first embodiment of the present invention compared with FIG. 16.

FIG. 14 is a schematic view (No. 1) showing an operation of the belt drive device according to the second embodiment of the present invention. FIG. 15 is a schematic view (No. 2) showing the operation of the belt drive device according to the second embodiment of the present invention. FIG. 16 is a schematic view (No. 3) showing the operation of the belt drive device according to the second embodiment of the present invention. FIG. 17 is a schematic perspective view showing the operation of the belt drive device according to the first embodiment of the present invention compared with FIG. 15. FIG. 18 is a schematic perspective view showing the operation of the belt drive device according to the first embodiment of the present invention compared with FIG. 16.

In the second embodiment, when the endless belt 51 moves in a winding path, the idle roller 53 is inclined to cancel the winding path of the endless belt 51 with an operation same as that in the first embodiment. Accordingly, explanation thereof is omitted.

An operation in which the urging member 75 and the cleaning blade unit 70 are situated at a position closer to the idle roller 53 relative to the intermediate point P1 of the belt frame 61 will be explained next. When the drive roller 52 and the idle roller 53 are situated in parallel, as shown in FIG. 14, the endless belt 51 is wound on an outer circumference of the idle roller 53 over 180 degrees in a range of a central angle.

In the second embodiment, when the idle roller 53 is shifted downward, as shown in FIG. 15, the endless belt 51 situated at the upstream side of the idle roller 53 or below the idle roller 53 is bent downward with the urging member 75 and the cleaning blade unit 70. As a result, the endless belt 51 is wound on the outer circumference of the idle roller 53 over 172 degrees in the range of the central angle.

On the other hand, in the belt drive device according to the first embodiment of the present invention, when the idle roller 53 is shifted downward, as shown in FIG. 17, the endless belt 51 situated at the upstream side of the idle roller 53 is not bent. As a result, the endless belt 51 is wound on the outer circumference of the idle roller 53 over 163.3 degrees in the range of the central angle.

In the second embodiment, when the idle roller 53 is shifted upward, as shown in FIG. 16, the endless belt 51 situated at the upstream side of the idle roller 53 is bent upward with the urging member 75 and the cleaning blade unit 70. As a result, the endless belt 51 is wound on the outer circumference of the idle roller 53 over 188.9 degrees in the range of the central angle.

On the other hand, in the belt drive device according to the first embodiment of the present invention, when the idle roller 53 is shifted downward, as shown in FIG. 18, the endless belt 51 situated at the upstream side of the idle roller 53 is not bent. As a result, the endless belt 51 is wound on the outer circumference of the idle roller 53 over 199.4 degrees in the range of the central angle.

As described above, in the second embodiment, when the idle roller 53 is shifted vertically, the endless belt 51 is wound on the outer circumference of the idle roller 53 with an angle variance in the range of the central angle to less extent as opposed to the first embodiment. The wound angle variances between the first and second embodiment is summarized as follows:

| | Parallel state | After shift | Variance |
|---|---|---|---|
| | Idle roller downward variance | | |
| Second embodiment | 180.0 degrees | 172.0 degrees | 8.0 degrees |
| First embodiment | 180.0 degrees | 163.3 degrees | 16.7 degrees |
| | Idle roller upward variance | | |
| Second embodiment | 180.0 degrees | 188.9 degrees | 8.9 degrees |
| First embodiment | 180.0 degrees | 199.4 degrees | 19.4 degrees |

In general, a belt extended by a plurality of rollers is shifted according to a degree of parallel arrangement of the rollers. Further, a roller with a belt wound thereon in a larger wound angle has larger influence on a winding path of the belt. Accordingly, when a winding path of a belt is adjusted by tilting a roller, if a wound angle of the belt relative to the roller changes, it is difficult to stably adjust the winding angle, thereby prolonging adjusting time or lowering adjustment accuracy.

Note that the idle roller 53 is not shifted vertically at the other end portion thereof, i.e., the side not provided with the roller tilting lever 64. Accordingly, the endless belt 51 is wound on the outer circumference of the idle roller 53 over a constant angle, i.e., 180.0 degrees, in the range of the central angle.

In the second embodiment, the endless belt 51 is wound on the outer circumference of the idle roller 53 with an angle variance in the range of the central angle to less extent as opposed to the first embodiment. Accordingly, it is possible to stably reduce the extent of the winding path of the endless belt 51 through tilting the idle roller 53, thereby making it possible to clean the endless belt 51 over the whole width thereof.

In the second embodiment, the endless belt 51 is extended between the two rollers, i.e., the drive roller 52 and the idle roller 53. When more than three rollers are disposed, the urging member 75 and the cleaning blade unit 70 may be situated close to a roller to be tilted for correcting the winding path relative to an intermediate point between the roller to be tilted for correcting the winding path and a roller situated at an upstream side thereof. With such a configuration, it is possible to obtain an effect same as that of the second embodiment.

As described above, in the second embodiment, the cleaning blade unit 70 and the urging member 75 facing the cleaning blade unit 70 are situated close to the idle roller 53 relative to the intermediate point P1 between the idle roller 53 to be tilted for correcting the winding path of the endless belt 51 and the idle roller 53 situated at the upstream side thereof. Accordingly, it is possible to clean the endless belt 51 over the whole width thereof, and to minimize the variance in the wound angle of the endless belt 51 when the idle roller 53 is shifted, thereby making it possible to stably correct the winding path of the endless belt 51.

Accordingly, it is possible to prevent the non-cleanable area from occurring due to the cleaning blade unit 70 not contacting with the endless belt 51. Therefore, it is possible to prevent the problem, in which toner may spread in a surrounding area of the belt drive device, or a foreign matter may stick to the surface of the drive roller 52 driving the endless belt 51 to reduce friction therebetween, thereby making it difficult to drive the endless belt 51. Further, it is possible to reduce time for correcting the winding path of the endless belt 51 and accurately correct the winding path of the endless belt 51.

Third Embodiment

A third embodiment of the present invention will be explained next. In the description below, elements in the third embodiment same as those in the first and second embodiments are designated by same reference numerals, and explanations thereof are omitted. The elements same as those in the first and second embodiments provide same effects.

Figure 19:
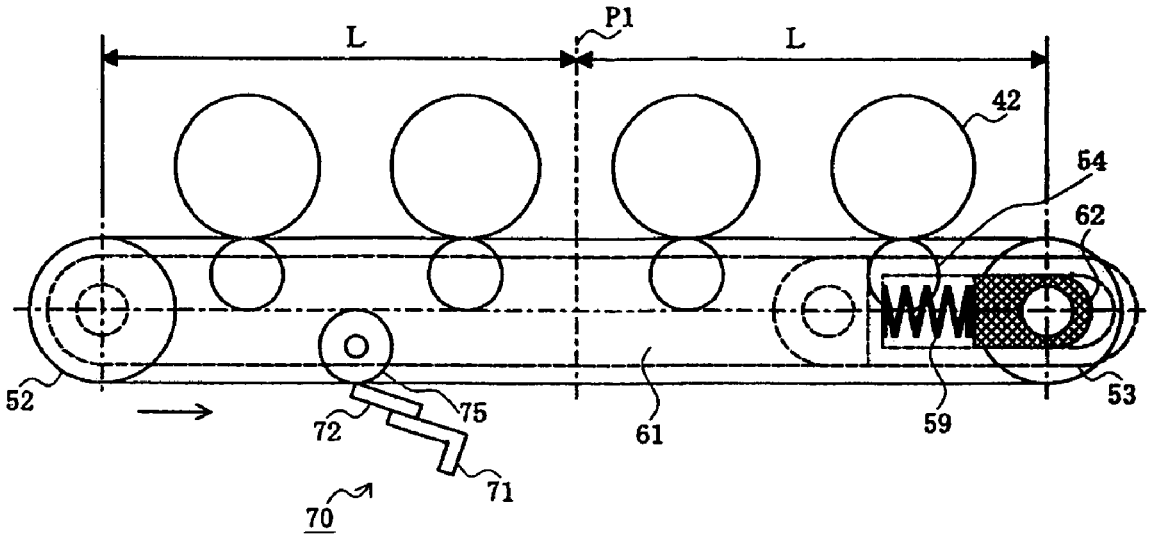
FIG. 19 is a schematic side view showing a belt drive device according to a third embodiment of the present invention.

FIG. 19 is a schematic side view showing a belt drive device according to the third embodiment of the present invention. In the third embodiment, the urging member 75 and the cleaning blade unit 70 are situated close to the drive roller 52 relative to the intermediate point P1 between the drive roller 52 and the idle roller 53. Other elements of the third embodiment are the same as those in the second embodiment, and explanation thereof are omitted.

An operation of the belt drive device according to the third embodiment of the present invention will be explained next.

Figure 20:
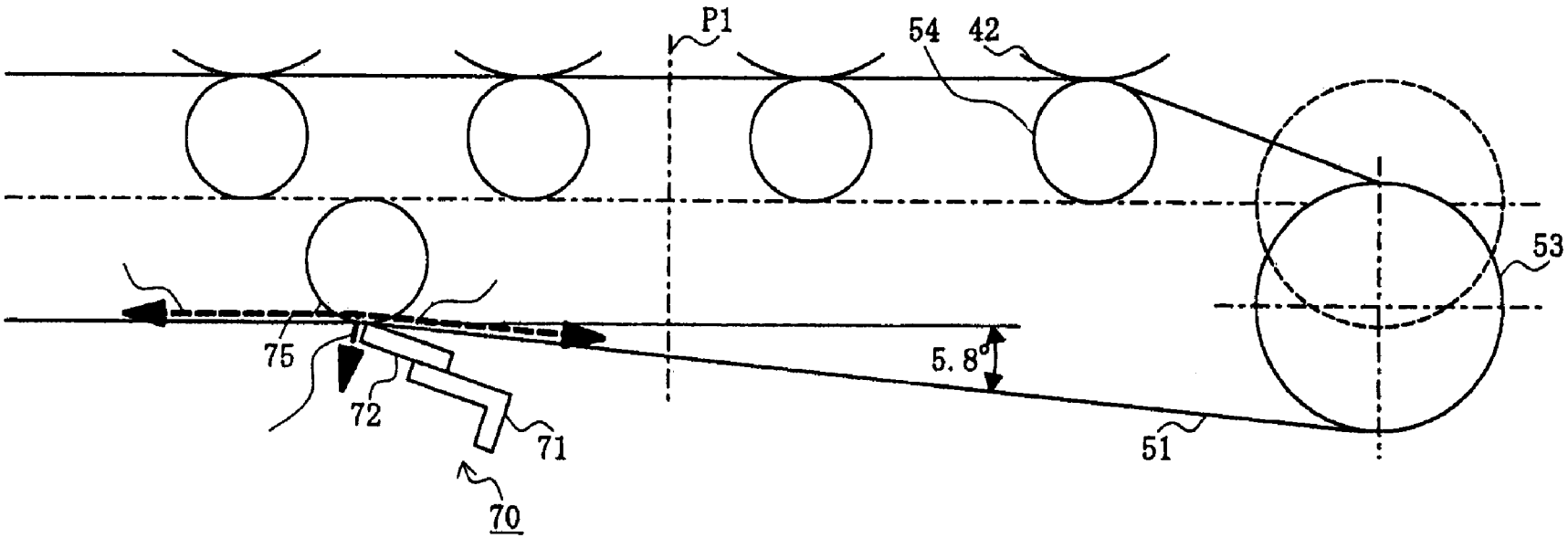
FIG. 20 is a schematic view showing an operation of the belt drive device according to the third embodiment of the present invention.
Figure 21:
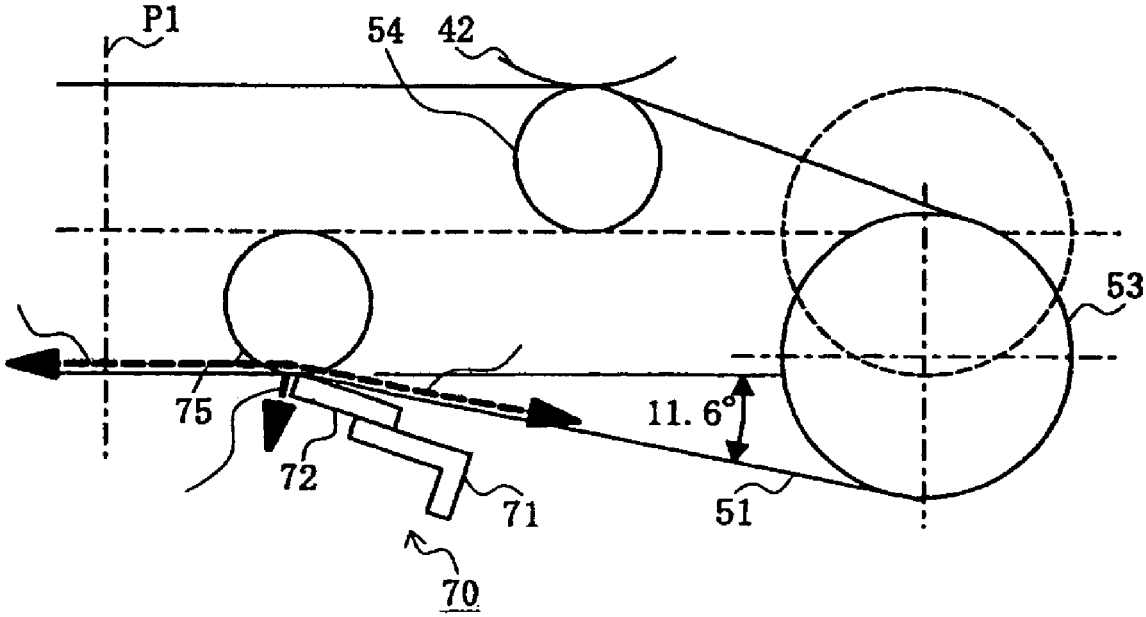
FIG. 21 is a schematic perspective view showing the operation of the belt drive device according to the second embodiment of the present invention compared with FIG. 20.

FIG. 20 is a schematic view showing an operation of the belt drive device according to the third embodiment of the present invention. FIG. 21 is a schematic perspective view showing the operation of the belt drive device according to the second embodiment of the present invention compared with FIG. 20.

In the third embodiment, the urging member 75 and the cleaning blade unit 70 are situated close to the drive roller 52 relative to the intermediate point P1. When the idle roller 53 is shifted, similar to the second embodiment, the endless belt 51 is wound with an angle variance to less extent as opposed to the first embodiment.

In the third embodiment, as shown in FIG. 20, when the idle roller 53 is shifted downward, the endless belt 51 is bent downward at a position where the endless belt 51 contacts with the cleaning blade unit 70. As a result, a sum of tension forces of the endless belt 51 is applied in a direction that the cleaning blade unit 70 moves away from the urging member 75, or the cleaning blade unit 70 is pressed against the endless belt 51 with a larger force. In this case, the endless belt 51 is bent at an angle of 5.8 degrees.

On the other hand, in the second embodiment, since the cleaning blade unit 70 is situated close to the idle roller 53, as shown in FIG. 21, when the idle roller 53 is shifted downward, the endless belt 51 is bent at an angle greater than that in the third embodiment. Accordingly, a sum of the tension forces of the endless belt 51 increases.

The bent angle of the endless belt 51 and the sum of the tension forces of the endless belt 51 under a belt tension force of 3 kg between the first and second embodiment were measured, and results are shown below:

| | Bent angle of transfer belt | Sum of tension forces |
|---|---|---|
| Third embodiment | 5.8 degrees | 0.3 kg |
| Second embodiment | 11.6 degrees | 0.6 kg |

As shown in the table above, in the third embodiment, the bent angle of the endless belt 51 and the sum of the tension forces of the endless belt 51 are reduced by about 50%.

Note that the idle roller 53 is not shifted vertically at the other end portion thereof, i.e., the side not provided with the roller tilting lever 64. Accordingly, the endless belt 51 is bent at 0 degree, and the sum of the tension forces of the endless belt 51 becomes 0 kg. As a result, it is possible to reduce an abutting force between the cleaning blade unit 70 and the endless belt 51 over the whole width of the endless belt 51.

The abutting force between the cleaning blade unit 70 and the endless belt 51 has large influence on cleaning performance. For example, when the abutting force is large, the cleaning performance is improved. However, the friction force against the endless belt 51 increases, so that the cleaning blade unit 70 may be lifted toward the downstream side in the rotational direction of the endless belt 51. On the other hand, when the abutting force is small, the cleaning performance is decreased, thereby making it difficult to scrape off toner or foreign matters from the endless belt 51.

In the third embodiment, the endless belt 51 is extended between the two rollers, i.e., the drive roller 52 and the idle roller 53. When more than three rollers are disposed, the urging member 75 and the cleaning blade unit 70 may be situated close to a roller at an upstream side relative to an intermediate point between a roller to be tilted for correcting the winding path and the roller situated at an upstream side thereof. With such a configuration, it is possible to obtain an effect same as that of the third embodiment.

As described above, in the third embodiment, the cleaning blade unit 70 and the urging member 75 facing the cleaning blade unit 70 are situated close to the drive roller 52 relative to the intermediate point P1 between the idle roller 53 to be tilted for correcting the winding path of the endless belt 51 and the idle roller 53 situated at the upstream side thereof. Accordingly, it is possible to clean the endless belt 51 over the whole width thereof, and to minimize the bent angle of the endless belt 51 at the abutting point relative to the cleaning blade unit 70 when the idle roller 53 is shifted downward. As a result, it is possible to reduce the abutting force between the cleaning blade unit 70 and the endless belt 51, thereby obtaining stable cleaning performance.

Accordingly, it is possible to prevent the problem, in which toner may accumulate in the non-cleanable area to make a surrounding area of the belt drive device dirty, or a foreign matter may be stick to the surface of the drive roller 52 driving the endless belt 51 to reduce friction therebetween, thereby making it difficult to drive the endless belt 51. Further, it is possible to prevent the problem, in which the cleaning blade unit 70 is twisted or the cleaning performance is lowered due to an increased abutting force between the cleaning blade unit 70 and the endless belt 51.

In the embodiments of the present invention, the endless belt 51 transports the sheet 11, so that an image is formed on the sheet 11. Alternatively, the present invention is applicable to a transfer belt in a photoelectric printer of an intermediate transfer type, in which an image is directly formed on the endless belt 51 and the image is transferred to a sheet.

The disclosure of Japanese Patent Application No. 2005-330999, filed on Nov. 16, 2005, is incorporated in the application.

While the invention has been explained with reference to the specific embodiments of the invention, the explanation is illustrative and the invention is limited only by the appended claims.

What is claimed is:

1. A belt drive device comprising:

a plurality of rollers;

an endless belt placed on the rollers to be movable;

a roller shaft shifting member disposed on at lease one end portion of a shaft of at least one of the rollers for shifting the one end portion of the shaft of the one of the rollers according to a movement of the endless belt in a shaft direction of the one of the rollers;

a cleaning member disposed to face the one of the rollers and contacting with the endless belt for cleaning a surface thereof; and a shifting member for shifting the cleaning member in the shaft direction of the one of the rollers when the endless belt moves in the shaft direction of the one of the rollers.

2. The belt drive device according to claim 1, wherein said cleaning member is arranged such that the cleaning member can clean the endless belt over a whole width thereof.

3. The belt drive device according to claim 1, wherein said cleaning member includes a cleaning blade formed of an elastic member abutting against the endless belt.

4. The belt drive device according to claim 1, wherein said cleaning member includes a roller member abutting against the endless belt and a cleaning blade formed of an elastic member abutting against the roller member.

5. A belt drive device, comprising:

a plurality of rollers;

an endless belt placed on the rollers to be movable;

a roller shaft shifting member disposed on at lease one end portion of a shaft of at least one of the rollers for shifting the one end portion of the shaft of the one of the rollers according to a movement of the endless belt in a shaft direction of the one of the rollers;

a cleaning member abutting against a surface of the endless belt; and an urging member disposed at a position facing the cleaning member with the endless belt in between, wherein said cleaning member and said urging member are disposed at an upstream side in a rotational direction of the endless belt relative to the one of the rollers.

6. The belt drive device according to claim 5, wherein said cleaning member is arranged such that the cleaning member can clean the endless belt over a whole width thereof.

7. The belt drive device according to claim 5, wherein said urging member is disposed at a position close to the one of the rollers relative to an intermediate point between the one of the rollers and another of the rollers arranged at an upstream side of the one of the rollers in a rotational direction of the endless belt.

8. The belt drive device according to claim 5, wherein said urging member is disposed at a position close to another of the rollers arranged at an upstream side of the one of the rollers in a rotational direction of the endless belt relative to an intermediate point between the one of the rollers and the another of the rollers.

9. The belt drive device according to claim 5, wherein said cleaning member includes a cleaning blade formed of an elastic member abutting against the endless belt.

10. The belt drive device according to claim 5, wherein said cleaning member includes a roller member abutting against the endless belt and a cleaning blade formed of an elastic member abutting against the roller member.

11. An image forming apparatus comprising the belt drive device according to claim 1 and an image forming unit for forming an image on the endless belt or a recording medium transported by the endless belt.

12. An image forming apparatus comprising the belt drive device according to claim 5 and an image forming unit for forming an image on the endless belt or a recording medium transported by the endless belt.

13. A belt drive device comprising:

a plurality of rollers;

an endless belt placed on the rollers to be movable;

a cleaning member disposed to face one of the rollers and contacting with the endless belt for cleaning a surface thereof; and a shifting member for shifting the cleaning member in a shaft direction of the one of the rollers when the endless belt moves in the shaft direction of the one of the rollers.

14. An image forming apparatus comprising the belt drive device according to claim 13 and an image forming unit for forming an image on the endless belt or a recording medium transported by the endless belt.

* * * * *